United States Patent [19]

Akagawa et al.

[11] Patent Number: 5,076,024

[45] Date of Patent: Dec. 31, 1991

[54] DISK POLISHER ASSEMBLY

[75] Inventors: Minoru Akagawa, Fremont; Ryo Narisawa, Palo Alto, both of Calif.

[73] Assignee: Intelmatec Corporation, Fremont, Calif.

[21] Appl. No.: 573,392

[22] Filed: Aug. 24, 1990

[51] Int. Cl.[5] ..... B24D 7/06

[52] U.S. Cl. ..... 51/209 DL; 51/266; 51/395

[58] Field of Search ..... 51/209 R, 209 DL, 266, 51/267, 131.3, 131.5, 132, 356, 283 R, 170 T

[56] References Cited

U.S. PATENT DOCUMENTS

| | | | |
|---|---|---|---|
| 1,742,594 | 1/1930 | Hitchcock | 51/209 R |
| 2,819,568 | 1/1958 | Kasick | 51/266 |
| 3,754,359 | 8/1973 | Scandaletos | 51/356 |
| 4,674,236 | 6/1987 | Kawakami et al. | 51/325 |
| 4,918,872 | 4/1990 | Sato et al. | 51/209 R |

FOREIGN PATENT DOCUMENTS

| | | | |
|---|---|---|---|
| 0249258 | 11/1986 | Japan | 51/131.5 |

*Primary Examiner*—Robert A. Rose

*Attorney, Agent, or Firm*—Heller, Ehrman, White & McAuliffe

[57] ABSTRACT

A disk polisher has a horizontal turntable for moving workpieces around thereon and an assembly for holding flat grinding surfaces of grinding stone against these moving workpieces. The grinding stone pieces are provided with throughholes and are attached to a supporting body having internal passageways. Orifices are provided to connect these internal passageways with the throughholes such that a high-pressure fluid such as air can be directed through the passageways and the throughholes to apply external force on processed workpieces which tend to stick to the grinding surfaces due to the surface tension of water used for grinding. The diametrical shapes of the orifices and throughholes are carefully determined such that the processed workpieces can be reliably separated while the pressure drop inside the passageway due to escaping air will be minimized.

12 Claims, 3 Drawing Sheets

DISK POLISHER ASSEMBLY

BACKGROUND OF THE INVENTION

This invention relates to a disk polisher for grinding and/or polishing disk-shaped workpieces, and more particularly to a component of such a disk polisher which comes into contact with the workpieces and from which polished or ground workpieces can be removed easily and dependably.

In the fabrication of disk-shaped objects such as memory disks, silicon wafers and optical mirrors (hereinafter generally referred to as workpieces), use is frequently made of an apparatus, herein broadly referred to as a disk polisher, having a horizontal turntable and a holder plate thereover. The workpieces to be polished or ground may be placed in indentations created on the top surface of a tray-like carrier as disclosed, for example, in U.S. Pat. Application Ser. No. 471,830, filed Jan. 29, 1990 and assigned to the present assignee, and the loaded carrier is placed on top of the turntable and rotated together therewith such that the workpieces undergo generally horizontal rotary motions. Pieces of grinding stone are attached to the holder plate above the turntable such that their flat grinding surfaces are not only horizontal but mutually coplanar, facing vertically downward. With the loaded carrier and the grinding stone pieces thus set, an abrasive is applied with water on the surfaces of the workpieces to be ground and the holder plate is lowered as the turntable is caused to rotate such that the top surfaces of the workpieces are ground by moving against the grinding stone surfaces.

When the holder plate is lifted after such an operation, however, the workpieces tend to remain stuck to the holder plate and be lifted therewith due to the surface tension of water used with the abrasive. This makes it difficult to unload the processed workpieces by an automatic means such as a robot gripper and the workpieces may be damaged if they drop after being lifted from the carrier surface.

When a disk polisher of this type is used for polishing disk-shaped workpieces instead of for grinding, a piece of polishing cloth may be attached to the holder plate instead of the pieces of grinding stone. In such a situation, too, it has been desirable to eliminate the problem of workpieces adhering to the holder plate when the holder plate is lifted after the workpieces are polished.

SUMMARY OF THE INVENTION

It is therefore an object of the present invention in view of the above to provide a disk polisher with an assembly which comes into contact with moving disk-shaped workpieces for polishing or grinding and from which the processed workpieces can be separated easily.

It is a further object of the present invention to provide such an assembly from which processed workpieces can be removed gently and gradually so as not to be damaged by being dropped from a height. The above and other objects of the present invention can be achieved by providing an improved grinding stone assembly characterized as having not only grinding stone pieces each with a flat grinding surface and attached to a supporting body but also in that internal fluid passages are formed through the supporting body and both the grinding stone pieces and the supporting body are provided with throughholes through which a high pressure fluid such as air can be directed outward from the internal passages to the grinding surfaces. The size and shape of the throughholes are specifically designed in order to be able to apply a sufficiently large force on the workpieces so as to overcome the surface tension of water by which processed workpieces are attached to the grinding stone pieces and also to reduce the drop in effective air pressure on the workpieces due to the flow of air through those of the throughholes which are not covered.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

This invention relates, in one aspect thereof, to a grinding stone assembly which is made a part of a disk polisher for polishing, lapping and/or grinding generally disk-shaped workpieces by means of a horizontal motor-operated turntable for causing the workpieces to move in a horizontal plane and a means for keeping grinding stone pieces in contact with these moving workpieces. Disk polishers of this type are known, including, for example, those produced and sold by Speedfam Corporation (Des Plaines, Illinois), and hence will not be described in detail herein.

Figure 1:
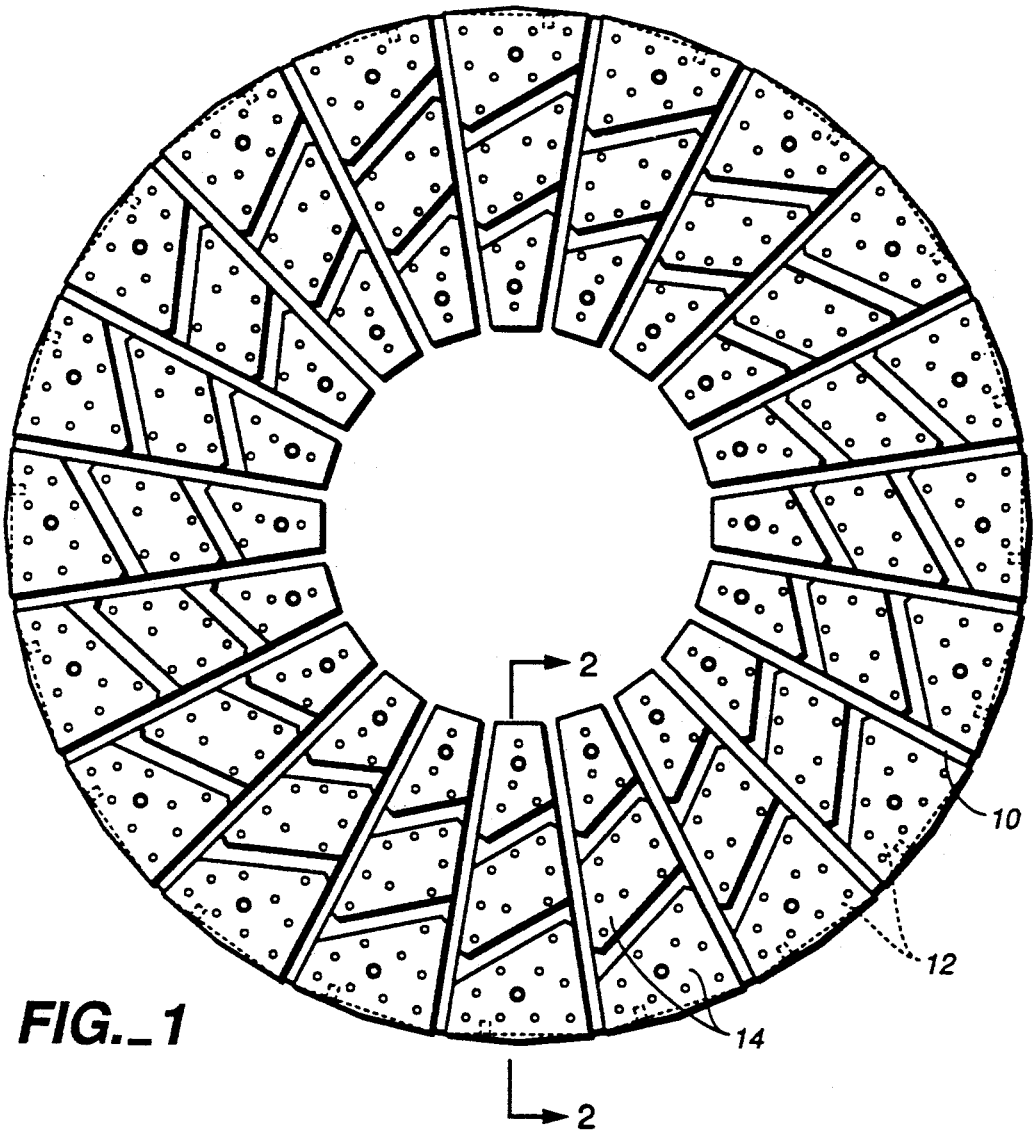
FIG. 1 is a schematic bottom view of a grinding stone assembly for a disk polisher embodying the present invention.
Figure 2:
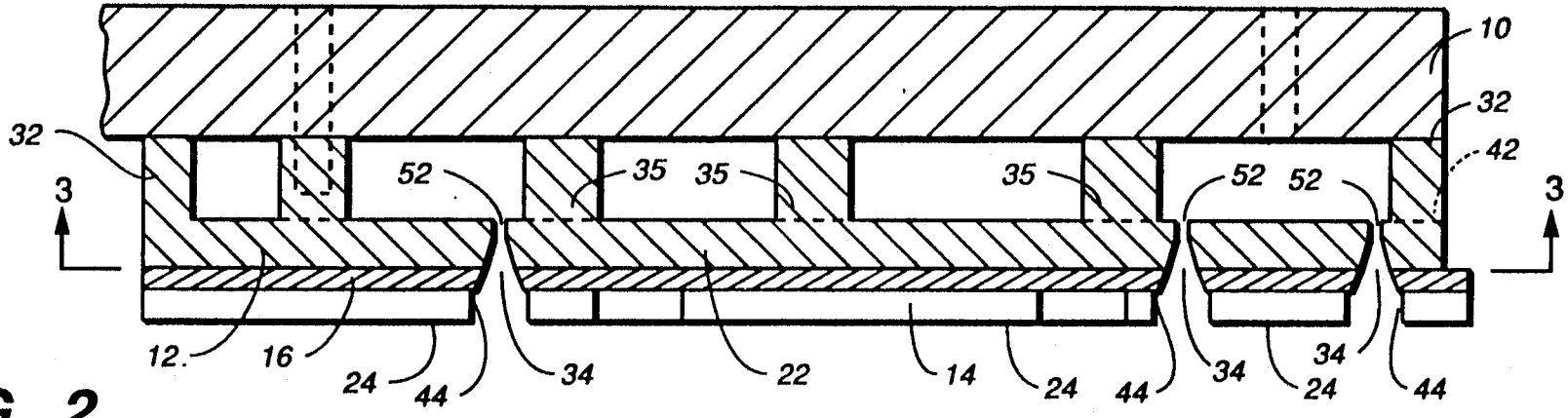
FIG. 2 is a graphical sectional view of the grinding stone assembly of FIG. 1 as seen along the line 2—2 shown therein, FIG. 3 bottom view of one of the manifold spacers shown in FIGS. 1 and 2 as seen along the line 3—3 of FIG. 2.
Figure 3:
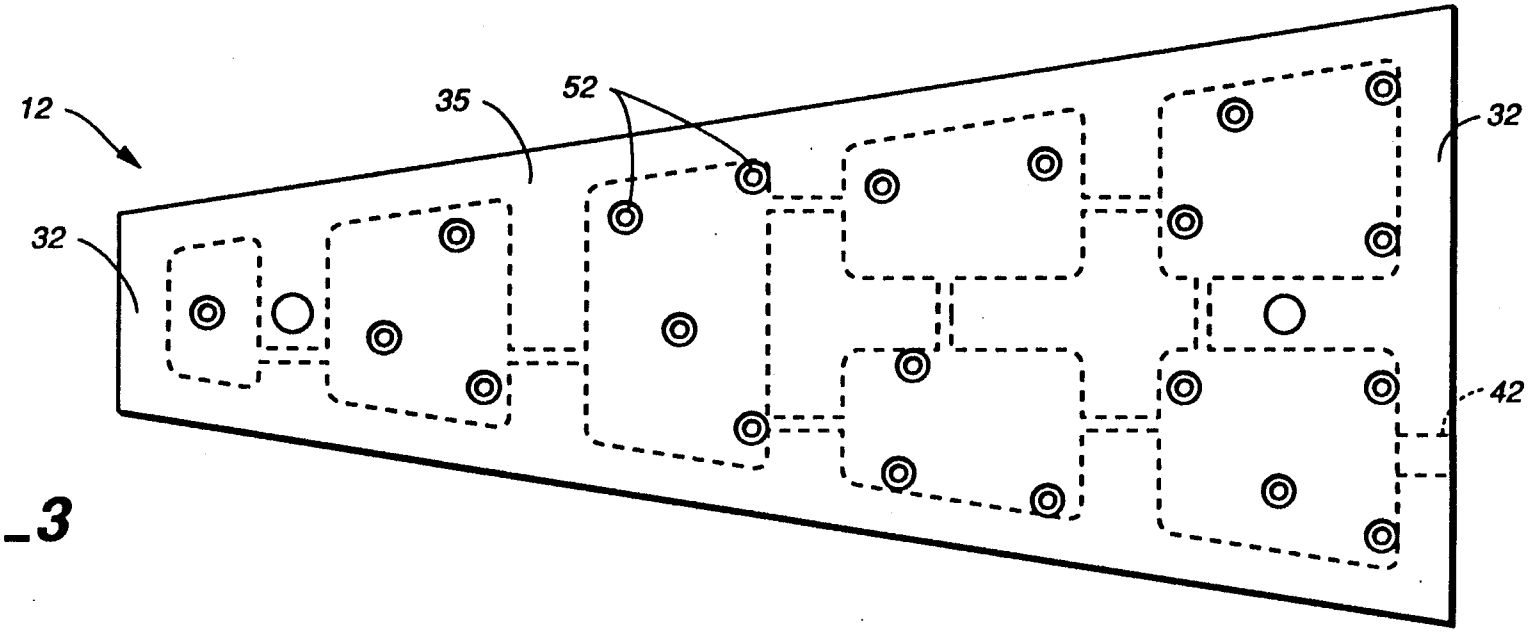

FIGS. 1 and 2 show schematically a grinding stone assembly according to the present invention which is intended to be used as a component of such a disk polisher. In FIGS. 1 and 2, numeral 10 indicates what will hereinbelow be referred to as a jig plate which is a circular disk capable not only of being kept in a horizontal position during a grinding operation but also of being lifted so as to allow the processed workpieces to be removed. There are a plurality (20 according to the embodiment shown in FIG. 1) of somewhat fan-shaped manifold spacers 12 attached to the bottom surface of the jig plate 10, arranged radially and symmetrically as shown in FIG. 1 so as to together cover a substantial fraction of the area of the circular bottom surface of the jig plate 10. Each manifold spacer 12 is shaped like a shallow box, as shown in FIG. 2, having a bottom floor 22 and side walls 32, and is attached to the bottom surface of the jig plate 10 such that the bottom floor 22 is parallel to the jig plate 10 and the side walls 32 make an airtight contact with the bottom surface of the jig plate 10. Numeral 42 indicates an opening formed on the radially outwardly facing part of the side wall 32. This opening 42 is to be connected to a source of high-pressure gas such as air (not shown) and hence to serve as an air intake. Numerals 35 indicate mesa-like structures unistructurally formed on the bottom floor 22 and protruding therefrom so as to generally give structural strength to the manifold spacer 12, preventing the bottom floor 22 from collapsing and maintaining the bottom floor 22 from the jig plate 10 at a predetermined constant distance. As shown in FIG. 2, and more clearly in FIG. 3 which is a bottom view of one of the manifold spacers 12, the bottom floor 22 is provided with a plurality of orifices 52 distributed substantially uniformly thereover. The chamber formed between the manifold spacer 12 and the jig plate 10 would constitute a sealed space but for these orifices 52 and the air intake opening 42.

Figure 4:
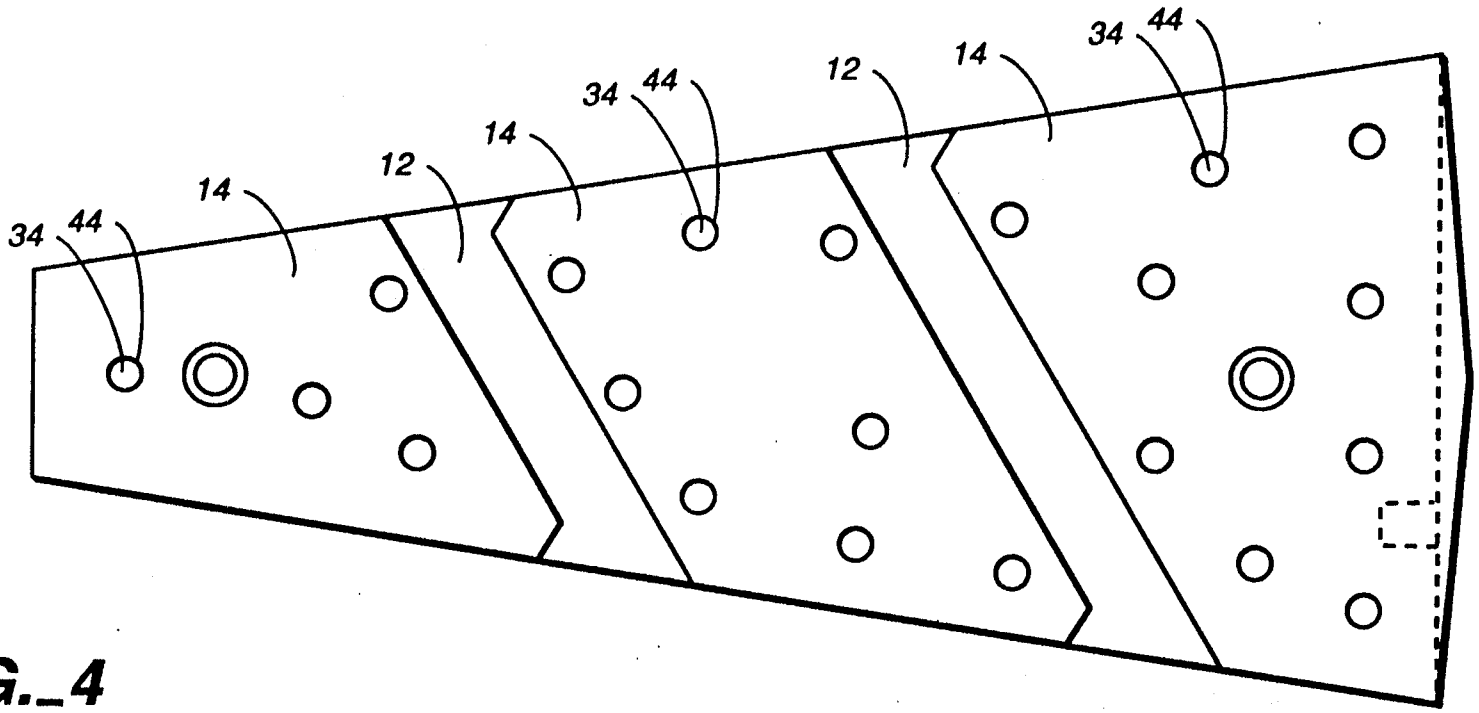
FIG. 4 is an enlarged view of a portion of FIG. 1 corresponding to one of the manifold spacers.

A plurality (three according to the embodiment shown in FIG. 1 and described more in detail below by way of FIG. 4) of grinding stone pieces 14 are attached to the bottom surface of each of the manifold spacers 12 with backing plates 16 in between. As shown in FIG. 2, these grinding stone pieces 14 are plate-like, having flat, mutually coplanar grinding surfaces 24 which are parallel to the jig plate 10 and the bottom floor 22 of the manifold spacer 12. As shown in FIGS. 2 and 4, these grinding stone pieces 14 and the backing plates 16 are provided with throughholes 34 at selected positions so as to coincide with the orifices 52 formed through the bottom floor 22 of the corresponding manifold spacer 12 and to form, together with the orifices 52, outlet passages for high-pressure air inside the sealed chamber between the jig plate 10 and the manifold spacer 12. These throughholes 34, and hence also the orifices 52 are distributed substantially uniformly and space apart as shown in FIG. 4 such that every workpiece during a grinding process covers at least one of the throughholes 34 at all times.

The method of using such a grinding stone assembly to grind disk-shaped workpieces has been described above. After such a grinding process with an abrasive and water, the processed workpieces tend to stick to the grinding surface 24 of the grinding stone pieces 14 and, as the assembly is raised upward, tend to remain stuck to the grinding stone pieces 14 and be lifted therewith. In order to overcome the surface tension of water and to have the processed workpieces released from the grinding surfaces 24, a high-pressure gas such as air is sent through the intake openings 42 to the sealed chambers formed between the individual manifold spacers 12 and the jig plate 10. The high-pressure air thus introduced into the sealed chambers will try to escape therefrom through the orifices 52 and the associated throughholes 34. Since the throughholes 34 are substantially uniformly distributed as mentioned above and a plurality of circular workpieces are simultaneously processed together, some of the throughholes 34 are not covered when the high-pressure air is introduced into the chambers and the air will immediately leak through such uncovered holes, thereby reducing the pressure inside the chambers. In order to enable the high-pressure air inside the chambers to apply sufficiently strong downward force on the workpieces attached to the grinding surfaces 24, the diameter of the throughholes 34 at the grinding surface 24 should be sufficiently large. On the other hand, it is desirable, as mentioned above, to keep the pressure drop reasonably low not only inside these chambers on the upstream side of the orifices 52 but also on the downstream side of the orifices. The latter consideration is particularly important because, if a workpiece is only partially released from the grinding surface before the pressure drops significantly above the workpiece, such a workpiece may fail to be completely released and remain hanging from the grinding stone as the assembly is raised.

The air pressure inside the chambers should preferably kept above a certain minimum level such as 15 psig. Generally speaking, however, the high-pressure fluid (such as air) supply system (not shown in FIG. 2 and to be connected through the intake opening 42) cannot maintain this minimum level of pressure if the flow rate exceeds a certain maximum rate determined, for example, by the capacity of the compression pump and the supply line size of the supply system. The orifices 52, therefore, should be sufficiently small to limit the flow rate through those of the throughholes 34 not covered by a workpiece and hence to reduce the pressure drop on the upstream side thereof, or inside the chambers. According to an preferred embodiment of the present invention, the diameter of the orifices 52 is 0.5–1.5 mm. The flow rate is unaffected by the pressure drop through the throughholes 34 and hence the determined orifice size virtually determines the pressure upstream of the orifices 52 (that is, inside the chambers).

Once the upstream pressure is thus determined, it is desirable, as explained above, to minimize the pressure drop on the downstream side of the orifices 52. According to the present invention, this is accomplished by providing smooth transitory nozzles (de Laval nozzles) as schematically shown in FIG. 2, thereby minimizing the pressure loss or achieving a supersonic flow. The nozzle expansion ratio is determined on the basis of the available pressure on the upstream side of the orifices 52 such that a maximum possible (supersonic) flow can be achieved at the exit (downstream side) of the nozzle. When the workpiece which originally covers the throughhole is slightly separated, the workpiece still receives a force close to the product of the dynamic pressure of the air at the exit of the nozzle and the exit area of the nozzle.

In FIGS. 2 and 4, numerals 44 indicate counter-bores formed through the grinding stone pieces 24 at positions corresponding to the throughholes 34 through the bottom floors 22 of the manifold spacers 12. These counter-bores 44 are significantly larger in area than the throughholes 34 so as to provide a sufficiently large downward force on the workpieces because the force applied on the workpiece at the position of each throughhole would be substantially proportional to the area size of the counter-bore 44. According to a preferred embodiment of the present invention, the counter-bores 44 are 5–15 mm in diameter.

The invention has been described above by way of a grinding stone assembly for a disk polisher but the description given above is by no means intended to limit the scope of the invention. For example, the number, shape and pattern of distribution of manifold spacers as well as those of grinding stone pieces on each manifold spacer may be varied within reasonable limits. The intake openings 42 need not be opening in radially outward directions. They may open inwardly or upward through the jig plate 10.

Figure 5:
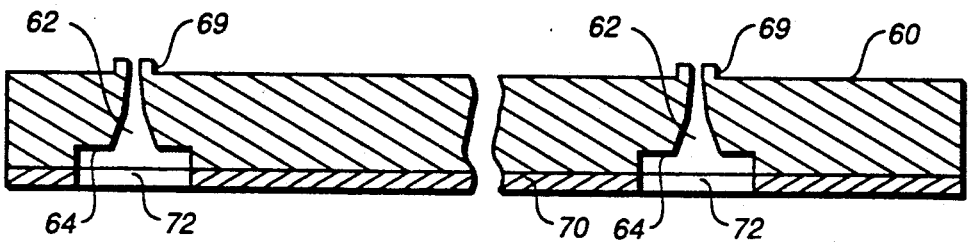
FIG. 5 is a graphical sectional view of a disk polishing assembly for a disk polisher embodying the present invention.

When the polisher is used for polishing workpieces rather than for grinding, grinding stone pieces are not required and a piece of cloth may be used instead. In order to prevent processed workpieces sticking to the polishing cloth, the basic principle of the present invention applied above in the case of grinding can be equally applied for polishing. FIG. 5 shows a jig plate 60 according to another embodiment of the present invention characterized by throughholes 62 therethrough. Numeral 70 indicates a piece of polishing cloth provided with holes 72 at positions that correspond to the throughholes 72 of the jig plate 60 so that a high-pressure gas such as air can be passed through the jig plate 60 and the workpieces which tend to stick to the cloth 70 can be effectively released therefrom. Numeral 64 indicate counter-bores formed on the downstream side of these throughholes 62 for the same purpose as those shown at 44 in FIGS. 2 and 4 and explained above in connection therewith. Means for attaching tubes for directing a high-pressure gas from a source (not shown) into these throughholes 62 are only schematically illustrated and indicated by numeral 69. Neither the shape of the throughholes 62 shown in FIG. 5 nor any design choice for the attaching means 69 is intended to limit the scope of the invention.

In summary, any variations that may be apparent to a person skilled in the art are intended to be within the scope of this invention.

What is claimed is:

1. A grinding stone assembly for a disk polisher comprising:

grinding stone pieces each with a flat grinding surface and throughholes opening on said flat grinding surface, and supporting means for supporting said grinding stone pieces, said grinding stone pieces being attached to said supporting means, said supporting means having intake openings, passageways being formed through said supporting means, and said passageways connecting said intake openings with said throughholes, said supporting means including a supporting plate and one or more spacers tightly attached to said supporting plate, each spacer having a bottom floor with orifices formed therethrough, said passageways being formed between said spacers and said supporting plate, said grinding stone pieces being attached to said bottom floors such that said orifices open into said throughholes.

2. The grinding stone assembly of claim 1 wherein said throughholes are substantially uniformly distributed over said grinding surface.

3. The grinding stone assembly of claim 1 wherein said throughholes are 5–15 mm in diameter at said grinding surface.

4. The grinding stone assembly of claim 3 wherein said orifices are 0.5–1.5 mm in diameter.

5. The grinding stone assembly of claim 1 wherein each of said orifices and corresponding one of said throughholes together form a continuous tunnel having a nozzle section with gradually increasing internal diameter such that a high-pressure liquid in said passageway can attain a maximum exit velocity upon passing therethrough.

6. The grinding stone assembly of claim 4 wherein each of said orifices and corresponding one of said throughholes together form a continuous tunnel having a nozzle section with gradually increasing internal diameter such that a high-pressure liquid in said passageway can attain a maximum exit velocity upon passing therethrough.

7. The grinding stone assembly of claim 5 wherein said grinding stone pieces have counter-bores with areas substantially larger than said orifices, said nozzle sections opening individually into said counter-bores.

8. The grinding stone assembly of claim 6 wherein said grinding stone pieces have counter-bores with areas substantially larger than said orifices, said nozzle sections opening individually into said counter-bores.

9. The grinding stone assembly of claim 1 wherein said supporting plate has a circular surface, said spacers being elongated and fan-shaped and each extending radially on said circular surface.

10. The grinding stone assembly of claim 1 wherein each of said spacers has one of said intake openings.

11. The grinding stone assembly of claim 9 wherein each of said spacers has one of said intake openings.

12. The grinding stone assembly of claim 11 wherein said intake openings open radially outwardly.

* * * * *